US011024972B2

(12) United States Patent
Jang et al.

(10) Patent No.: US 11,024,972 B2
(45) Date of Patent: Jun. 1, 2021

(54) ANTENNA AND ANTENNA MODULE INCLUDING THE ANTENNA

(71) Applicant: SAMSUNG ELECTRO-MECHANICS CO., LTD., Suwon-si (KR)

(72) Inventors: Seung Goo Jang, Suwon-si (KR); Eun Kyoung Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 377 days.

(21) Appl. No.: 15/795,892

(22) Filed: Oct. 27, 2017

(65) Prior Publication Data

US 2018/0123222 A1 May 3, 2018

(30) Foreign Application Priority Data

Oct. 28, 2016 (KR) ..... 10-2016-0142189
Sep. 22, 2017 (KR) ..... 10-2017-0122323

(51) Int. Cl.

| | |
|---|---|
| ***H01Q 9/04*** | (2006.01) |
| ***H01Q 21/30*** | (2006.01) |
| ***H01Q 19/00*** | (2006.01) |
| ***H01Q 21/06*** | (2006.01) |
| ***H01Q 1/22*** | (2006.01) |

(52) U.S. Cl.

CPC ..... *H01Q 9/0457* (2013.01); *H01Q 1/2291* (2013.01); *H01Q 9/0428* (2013.01); *H01Q 19/005* (2013.01); *H01Q 21/065* (2013.01); *H01Q 21/30* (2013.01)

(58) Field of Classification Search

CPC .. H01Q 9/0414; H01Q 9/0457; H01Q 19/005; H01Q 9/0428

See application file for complete search history.

(56) References Cited

U.S. PATENT DOCUMENTS

| | | | | |
|---|---|---|---|---|
| 7,209,080 | B2 | 4/2007 | Crouch et al. | |
| 7,486,239 | B1 | 2/2009 | Channabasappa | |
| 10,381,747 | B2 * | 8/2019 | Chien | H01Q 9/0464 |
| 2011/0199279 | A1 * | 8/2011 | Shen | H01Q 9/0435 343/857 |
| 2015/0116173 | A1 | 4/2015 | Zhang et al. | |

(Continued)

FOREIGN PATENT DOCUMENTS

| | | |
|---|---|---|
| CN | 102110907 A | 6/2011 |
| CN | 102570015 A | 7/2012 |

(Continued)

OTHER PUBLICATIONS

Chinese Office Action dated Jun. 26, 2019 in counterpart Chinese Patent Application No. 201711034800.5 (20 pages in English and 14 pages in Chinese).

(Continued)

*Primary Examiner* — Graham P Smith
*Assistant Examiner* — Amal Patel
(74) *Attorney, Agent, or Firm* — NSIP Law

(57) ABSTRACT

An antenna includes feed pads; a radiating portion disposed on one side of the feed pads and spaced apart from the feed pads, the radiating portion being constituted by a single conductor plate; and a ground part disposed on an opposite side of the feed pads from the radiating portion; wherein each of the feed pads has a polygonal shape.

20 Claims, 6 Drawing Sheets

(56) References Cited

U.S. PATENT DOCUMENTS

| | | | | |
|---|---|---|---|---|
| 2015/0194730 | A1 | 7/2015 | Sudo et al. | |
| 2016/0104934 | A1* | 4/2016 | Jang | H01Q 1/38 343/834 |
| 2017/0125919 | A1 | 5/2017 | Chien et al. | |
| 2018/0123222 | A1 | 5/2018 | Jang et al. | |

FOREIGN PATENT DOCUMENTS

| | | | |
|---|---|---|---|
| CN | 102882004 | A | 1/2013 |
| CN | 103259095 | A | 8/2013 |
| CN | 205595456 | U | 9/2016 |
| JP | 2005-117139 | A | 4/2005 |
| JP | 2013-223000 | A | 10/2013 |
| JP | 3205721 | U | 8/2016 |
| JP | 2018-74583 | A | 5/2018 |
| KR | 10-2011-0010938 | A | 2/2011 |
| KR | 10-2011-0126488 | A | 11/2011 |
| KR | 10-1164618 | B1 | 7/2012 |
| KR | 10-2015-0041054 | A | 4/2015 |
| KR | 10-2016-0042740 | A | 4/2016 |

OTHER PUBLICATIONS

Korean Office Action dated Sep. 17, 2018 in corresponding Korean Patent Application No. 10-2017-0122323 (7 pages in English and 6 pages in Korean).

Japanese Office Action dated Oct. 23, 2018 in corresponding Japanese Patent Application No. 2017-208273 (5 pages in English and 2 pages in Japanese).

Chinese Office Action dated Mar. 1, 2021 in counterpart Chinese Patent Application No. 201711034800.5 (22 pages in English and 15 pages in Chinese).

* cited by examiner

ANTENNA AND ANTENNA MODULE INCLUDING THE ANTENNA

CROSS-REFERENCE TO RELATED APPLICATIONS

This application claims benefit under 35 USC 119(a) of Korean Patent Application Nos. 10-2016-0142189 filed on Oct. 28, 2016, and 10-2017-0122323 filed on Sep. 22, 2017, in the Korean Intellectual Property Office, the entire disclosures of which are incorporated herein by reference for all purposes.

BACKGROUND

1. Field

This application relates to an antenna and an antenna module including the antenna.

2. Description of Related Art

Existing communications systems commonly use the UHF (Ultra High Frequency) band, but future new communications systems for high-speed information transmission are expected to operate at a frequency of 60 GHz in the EHF (Extremely High Frequency) using the 802.11ad standard.

Communications systems using EHF band signals for high-speed information transmission use a wide bandwidth that is 10 to 100 times greater than the bandwidth used in UHF band communications systems. Since communications systems operating at a frequency of 60 GHz in the EHF band may have a high signal transmission loss due to a high frequency, unlike a general communications system using the UHF band, a plurality of antennas are needed. Accordingly, communications systems using the EHF band need to have a plurality of antennas embedded in a printed circuit board.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna includes feed pads; a radiating portion disposed on one side of the feed pads and spaced apart from the feed pads, the radiating portion being constituted by a single conductor plate; and a ground part disposed on an opposite side of the feed pads from the radiating portion; wherein each of the feed pads has a polygonal shape.

The feed pads may be disposed so that all portions of the feed pads face the radiating portion.

The feed pads may include a first feed pad and a second feed pad disposed in a line and spaced apart from each other.

The antenna may further include a first via having a first end coupled to the first feed pad; and a second via having a first end coupled to the second feed pad.

The antenna may further include a first feed pattern and a second feed pattern disposed on an opposite side of the ground part from the first feed pad and the second feed pad and spaced apart from the ground part; the first via and the second via may penetrate through the ground part; a second end of the first via may be connected to the first feed pattern; and a second end of the second via may be connected to the second feed pattern.

Each of the feed pads may have a rectangular shape.

The radiating portion may have a rectangular shape; a length of each of the feed pads may be 40% or less of a length of the radiating portion; and a width of each of the feed pads may be 30% or less of a width of the radiating portion.

A radiating frequency of the antenna may be determined by a combination of a length of one of the feed pads and a length of the radiating portion; and an impedance of the antenna may be determined by either one or both of a position of the one feed pad and an area of the one feed pad.

The feed pads may include four feed pads disposed in four directions relative to a central point between the four feed pads to enable the antenna to receive a signal having a dual polarization.

The antenna may further include a meta ground part disposed between the feed pads and the ground part, the meta ground part not being electrically connected to any of the feed pads and the ground part.

The meta ground part may include eight conductive pads disposed in a quadrangular ring shape.

The antenna of claim 1 may further include a dummy pattern; and the feed pads and the dummy pattern may be disposed on a same plane.

The feed pads may include four feed pads disposed in four directions relative to a central point between the four feed pads; and the dummy pattern may include four conductive pads disposed so that each of the four conductive pads is disposed between a different pair of two feed pads of the four feed pads.

In another general aspect, an antenna module includes the antenna described above; and a signal processing element electrically connected to the feed pads and configured to transmit and receive a signal via the antenna.

The antenna module may further include an additional antenna; and the antenna described above and the additional antenna are configured to operate as an array antenna.

The antenna described above may be an antenna for Wi-Fi operating at a frequency of 60 GHz.

In another general aspect, an antenna includes a radiating portion constituted by a single conductor plate; a ground part; and feed pads disposed between the radiating portion and the ground part and spaced apart from the radiating portion and the ground part; wherein a total area of the feed pads is less than an area of the radiating portion.

All portions of the feed pads may face the radiating portion; an inner portion of the ground part may face the feed pads and the radiating portion; and an outer portion of the ground part may not face any portion of the feed pads and the radiating portion.

The feed pads may include a first feed pad and a second feed pad; and the antenna may further include a first feed pattern and a second feed pattern both disposed on an opposite side of the ground part from the radiating portion; a first via connecting the first feed pad to the first feed pattern; and a second via connecting the second feed pad to the second feed pattern. the first via may be connected to a portion of the first feed pad that is closest to the second feed pad; and the second via may be connected to a portion of the second feed pad that is closest to the first feed pad.

The antenna may further include a meta ground part disposed between the feed pads and the ground part, the meta ground part not being electrically connected to any of the feed pads and the ground part; and all portions of the feed pads may face both the radiating portion and the meta ground part.

In another general aspect, an antenna includes a radiating portion constituted by a single conductor plate; a ground part; a first feed pad and a second feed pad disposed between the radiating portion and the ground part on a line extending in a first polarization direction; and a third feed pad and a fourth feed pad disposed between the radiating portion and the ground part on a line extending in a second polarization direction different from the first polarization direction; wherein the first feed pad, the second feed pad, the third feed pad, and the fourth feed pad are disposed on a same plane; and all portions of the first feed pad, the second feed pad, the third feed pad, and the fourth feed pad face the radiating portion.

The first feed pad and the second feed pad may have a same length in the first polarization direction to provide the antenna with a multiple feeding capability for a signal polarized in the first polarization direction; and the third feed pad and the fourth feed pad may have a same length in the second polarization direction to provide the antenna with a multiple feeding capability for a signal polarized in the second polarization direction.

The antenna may further include a dummy pattern disposed on the plane on which the first feed pad, the second feed pad, the third feed pad, and the fourth feed pad are disposed, the dummy pattern not being electrically connected to any of the ground part, the first feed pad, the second feed pad, the third feed pad, and the fourth feed pad; and the dummy pattern may include a first conductive pad disposed adjacent to the first feed pad and the second feed pad; a second conductive pad disposed adjacent to the second feed pad and the third feed pad; a third conductive pad disposed adjacent to the third feed pad and the fourth feed pad; and a fourth conductive pad disposed adjacent to the fourth feed pad and the first feed pad.

The antenna may further include a meta ground part disposed between the ground part and the first feed pad, the second feed pad, the third feed pad, the fourth feed pad, the first conductive pad, the second conductive pad, the third conductive pad, and the fourth conductive pad, the meta ground part not being electrically connected to any of the ground part, the first feed pad, the second feed pad, the third feed pad, the fourth feed pad, the first conductive pad, the second conductive pad, the third conductive pad, and the fourth conductive pad; and wherein the meta ground part may include a fifth conductive pad disposed between the ground part and the first conductive pad; a sixth conductive pad disposed between the ground part and the first feed pad; a seventh conductive pad disposed between the ground part and the second conductive pad; an eighth conductive pad disposed between the ground part and the second feed pad; a ninth conductive pad disposed between the ground part and the third conductive pad; a tenth conductive pad disposed between the ground part and the third feed pad; an eleventh conductive pad disposed between the ground part and the fourth conductive pad; and a twelfth conductive pad disposed between the ground part and the fourth feed pad.

Other features and aspects will be apparent from the following detailed description, the drawings, and the claims.

DETAILED DESCRIPTION

Figure 1:
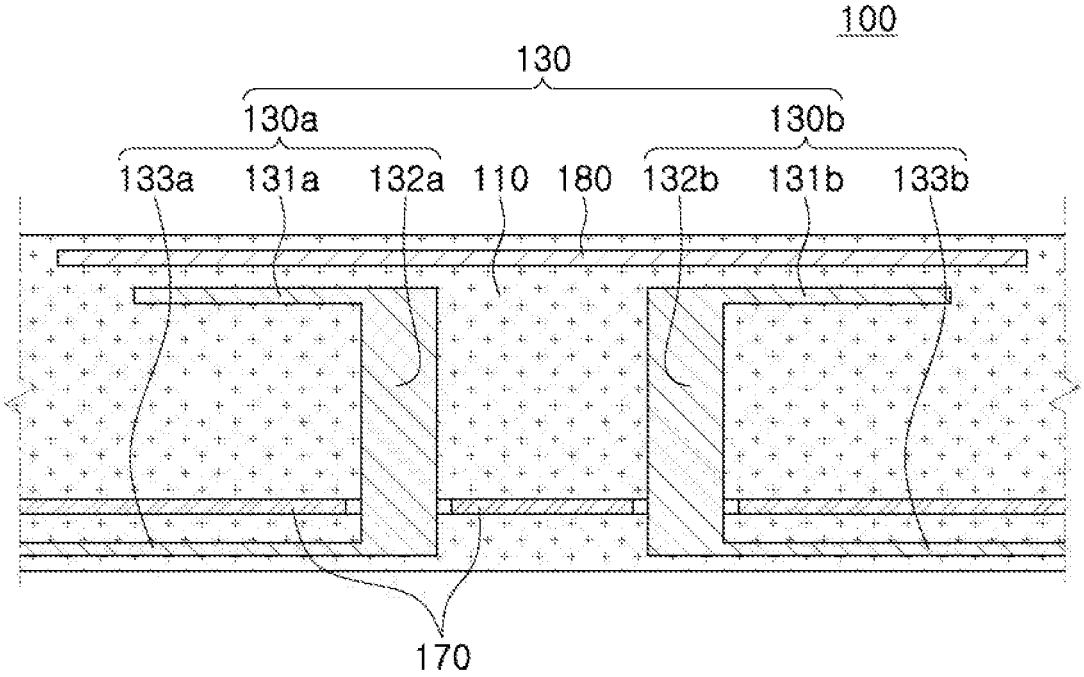
FIG. 1 is a cross-sectional view schematically illustrating an example of an antenna.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

Figure 2:
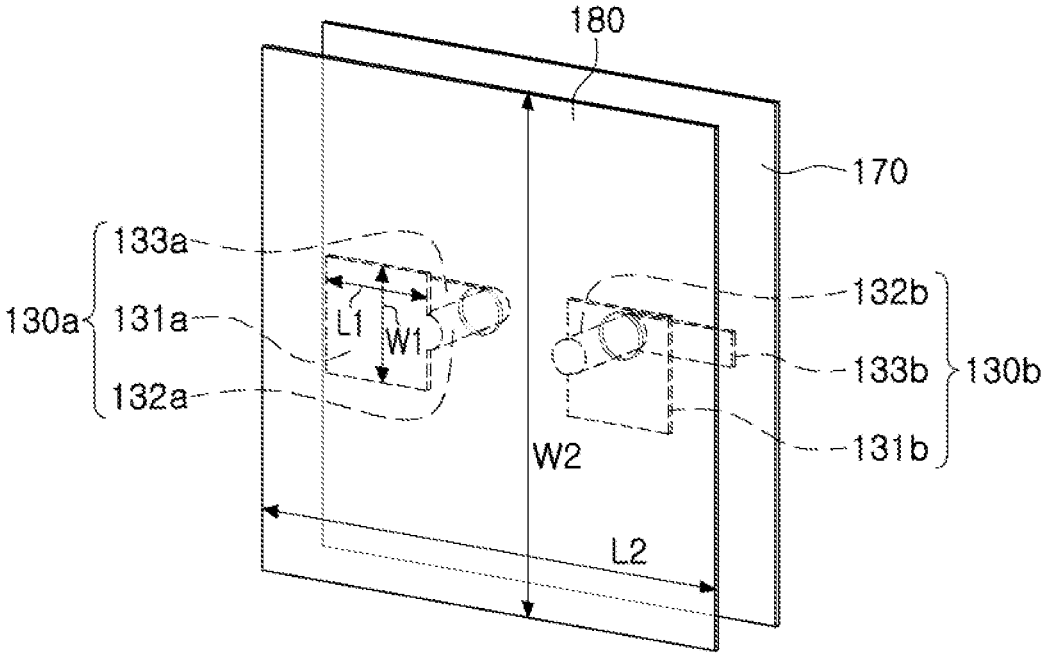
FIG. 2 is a perspective view of the antenna illustrated in FIG. 1.

FIG. 1 is a cross-sectional view schematically illustrating an example of an antenna, and FIG. 2 is a perspective view of the antenna illustrated in FIG. 1 in which an insulating member is omitted.

Referring to FIGS. 1 and 2, an antenna 100 includes an insulating member 110, a feed portion 130, a radiating portion 180, and a ground part 170.

As the insulating member 110, an insulating substrate may be used. For example, the insulating member may be a multilayer substrate formed of a plurality of layers and may be any one of a ceramic substrate, a printed circuit board, and a flexible substrate. However, the insulating member 110 is not limited thereto.

The feed portion 130 includes a first feed portion 130*a* and a second feed portion 130*b*. The first feed portion 130*a* includes a first feed pad 131*a*, a first feed pattern 133*a*, and a first via 132*a* connecting the first feed pattern 133*a* and the first feed pad 131*a* to each other. Further, the second feed portion 130*b* includes a second feed pad 131*b*, a second feed pattern 133*b*, and a second via 132*b* connecting the second feed pattern 133*b* and the second feed pad 131*b* to each other.

The feed pads 131*a* and 131*b* are disposed on a same plane.

In the example illustrated in FIGS. 1 and 2, the first feed pad 131*a* and the second feed pad 131*b* have the same shape and area, and are disposed in a line spaced apart from each other by a predetermined distance.

The feed pads 131*a* and 131*b* have a polygonal shape, and have a substantially rectangular shape in the example illustrated in FIGS. 1 and 2. However, this is merely an example, and the feed pads 131*a* and 131*b* may have other shapes. For example, the feed pads 131*a* and 131*b* may have a square shape.

Referring to FIG. 2, a width W1 of each of the feed pads 131*a* and 131*b* is 30% or less of a width W2 of the radiating portion 180, and a length L1 of each of the feed pads 131*a* and 131*b* is 40% or less of a length L2 of the radiating portion 180. If the feed pads 131*a* and 131*b* have a length and width greater than the above-mentioned width and length, a radiation efficiency of the antenna 100 may be degraded.

The feed pads 131*a* and 131*b* are connected to the feed patterns 133*a* and 133*b* by the vias 132*a* and 132*b*.

The vias 132*a* and 132*b* extend from lower surfaces of the feed pads 131*a* and 131*b* perpendicularly to the feed pads 131*a* and 131*b* and are connected to the feed patterns 133*a* and 133*b*. Therefore, one end of each of the vias 132*a* and 132*a* is connected to a respective one of the feed pads 131*a* and 131*b*, and the other end of the vias 132*a* and 132*a* is connected to a respective one of the feed patterns 133*a* and 133*b*.

The first via 132*a* is connected to the first feed pad 131*a*, and the second via 132*b* is connected to the second feed pad 131*b*.

In the example illustrated in FIGS. 1 and 2, the first via 132*a* and the second via 132*b* are disposed at positions shifted to one side of the feed pads 131*a* and 131*b*, rather than being disposed at centers of the feed pads 131*a* and 131*b*. More specifically, the first via 132*a* connected to the first feed pad 131*a* is disposed at a position as close as possible to the second feed pad 131*b*. Further, the second via 132*b* connected to the second feed pad 131*b* is disposed at a position as close as possible to the first feed pad 131*a*.

However, the first via 132*a* and the second via 132*b* are not limited to the above-mentioned configuration, and the first via 132*a* and the second via 132*b* may be disposed at various positions as long as they are coupled to the first feed pad 131*a* and the second feed pad 131*b* in the various positions. If the first via 132*a* and the second via 132*b* are disposed too close to each other, interference between a signal transmitted through the first via 132*a* and a signal transmitted through the second via 132*b* may occur. To reduce or substantially prevent such interference, the first via 132*a* and the second via 132*b* should be spaced apart from each other by 10% or more of the length L2 of the radiating portion 180.

In the example illustrated in FIGS. 1 and 2, the first via 132*a* and the second via 132*b* penetrate through the ground part 170 and are connected to the feed patterns 133*a* and 133*b* disposed below the ground part 170. In this example, the vias 132*a* and 132*b* are electrically insulated from the ground part 170.

The feed patterns 133*a* and 133*b* are disposed below the ground part 170. Therefore, the ground part 170 is disposed between the feed patterns 133*a* and 133*b* and the feed pads 131*a* and 131*b*.

The feed patterns 133*a* and 133*b* may be connected to a signal processing element (not shown) to transfer a signal applied to the feed patterns 133*a* and 133*b* by the signal processing element to the feed pads 131*a* and 131*b* through the vias 132*a* and 132*b*.

The first feed pattern 133*a* and the second feed pattern 133*b* are not connected to each other, and are independently connected to the signal processing element.

The first feed portion 130*a* and the second feed portion 130*b* may be used to transmit and receive a signal having a single polarization. Since two feed portions 130 are provided for the single polarization, the antenna 100 illustrated in the example of FIGS. 1 and 2 may be used to implement a multiple feeding. For example, a same signal may be applied to both the first feed portion 130*a* and the second feed portion 130*b*.

To this end, the first feed portion 130*a* and the second feed portion 130*b* have the same length as each other. Further, the first feed portion 130*a* and the second feed portion 130*b* are disposed in a symmetrical structure.

The radiating portion 180 is disposed on one side of the feed pads 131*a* and 131*b*. In the example illustrated in FIGS. 1 and 2, the radiating portion 180 is disposed above the feed pads 131*a* and 131*b*.

The radiating portion 180 is spaced apart from the feed pads 131*a* and 131*b* by a predetermined distance, and is constituted by a single conductor plate. The radiating portion 180 is disposed parallel to the feed pads 131*a* and 131*b*, and has a size covering the entirety of the feed pads 131*a* and 131*b*. That is, the radiating portion 180 faces every portion of the feed pads 131*a* and 131*b*.

In the example illustrated in FIGS. 1 and 2, the radiating portion 180 has a rectangular shape. However, this is merely an example, and the radiating portion 180 may have other shapes as needed.

Since the radiating portion 180 in the example illustrated in FIGS. 1 and 2 has a radiating area greater than a radiating area of a conventional radiating portion, the antenna 100 in the example of FIGS. 1 and 2 has a high gain characteristic.

The feed pads 131*a* and 131*b* are disposed within a region facing the radiating portion 180. Therefore, the feed pads 131*a* and 131*b* may be disposed at various positions within a range in which the entirety of the feed pads 131*a* and 131*b* faces the radiating portion 180.

The degree of freedom of the position of the feed pads 131*a* and 131*b* makes it possible to adjust an input impedance of the antenna by changing the positions of the feed pads 131*a* and 131*b*, thereby increasing an efficiency of the antenna 100 and implementing a high gain antenna.

The ground part 170 is disposed on the opposite side of the feed pads 131*a* and 131*b* from the radiating portion 180, and has an area larger than the areas of the feed portion 130 and the radiating portion 180. In the example illustrated in FIGS. 1 and 2, the ground part 170 is disposed below the feed pads 131*a* and 131*b*.

The ground part 170 is disposed parallel to the feed pads 131*a* and 131*b*, and has spaces through which the vias 132*a* and 132*b* penetrate.

Figure 3:
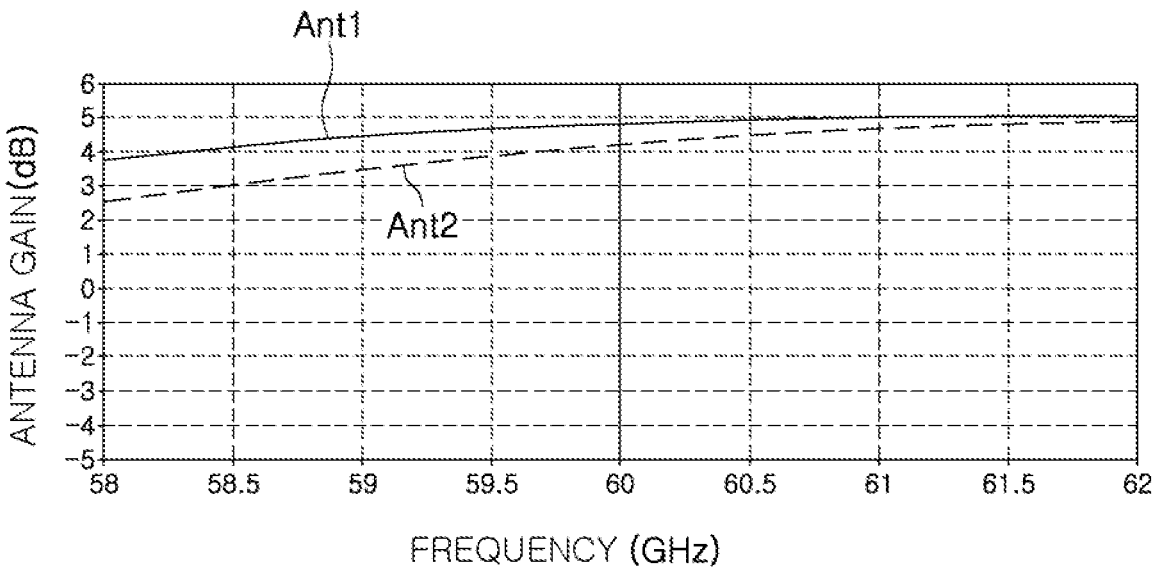
FIG. 3 is a graph illustrating an antenna gain measured for the antenna illustrated in FIG. 1.
Figure 4:
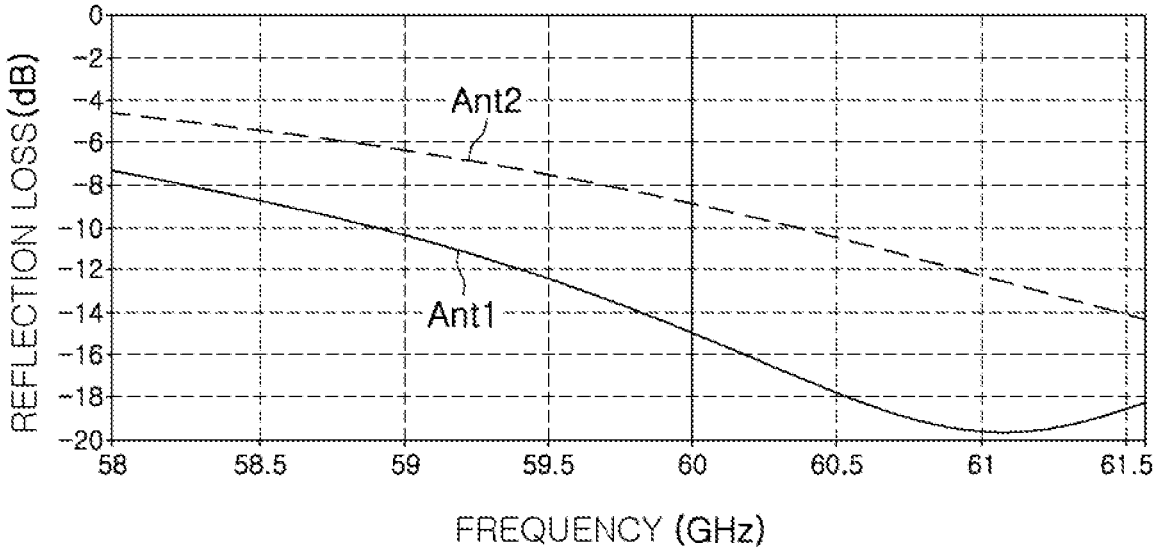
FIG. 4 is a graph illustrating a reflection loss measured the antenna illustrated in FIG.

FIG. 3 is a graph illustrating an antenna gain measured for the antenna illustrated in FIG. 1, and FIG. 4 is a graph illustrating a reflection loss measured for the antenna illustrated in FIG. 1. In FIG. 3, Ant1 denotes a first antenna Ant1 in which the entirety of the feed pads 131*a* and 131*b* is disposed in a range facing the radiating portion 180 as in the example illustrated in FIGS. 1 and 2, and Ant2 denotes a second antenna Ant2 in which at least a portion of the feed pads 131*a* and 131*b* does not face the radiating portion 180.

Referring to FIGS. 3 and 4, it may be seen that the first antenna Ant1 in which the entirety of the feed pads 131*a* and 131*b* is disposed in the range facing the radiating portion 180 as in the example illustrated in FIGS. 1 and 2 has a measured antenna gain approximately 1 dB higher than the second antenna Ant2. Further, it may be confirmed that the first antenna Ant1 has a measured reflection loss 2 dB or more lower than the second antenna Ant2.

Therefore, it may be seen that when the entirety of the feed pads 131*a* and 131*b* is disposed in the range facing the radiating portion 180, an antenna efficiency is improved, and accordingly, the entirety of the feed pads 131*a* and 131*b* of the feed portion 130 of the antenna in the example illustrated in FIGS. 1 and 2 is disposed within the region facing the radiating portion 180.

The antenna 100 in the example illustrated in FIGS. 1 and 2 having the configuration described above has the radiating portion 180. Further, the feed portion 130 is spaced apart from the radiating portion 180 so that the feed portion 130 does not contact the radiating portion 180, and transfers a signal to the radiating portion 180 through a coupling with the radiating portion 180.

Therefore, a radiating area or aperture of the antenna 100 in the example illustrated in FIGS. 1 and 2 is increased compared to a conventional dipole antenna, and an amplitude of the signal radiated through the increased radiating area is increased, thereby providing the antenna 100 with a high gain.

In the case of the conventional dipole antenna, since the radiating portion extends from the feed portion, the radiating portion is formed as a linear type radiating portion or a rod type radiating portion and has a length equal to a length of a half wavelength of a frequency to be transmitted or received by the conventional dipole antenna.

On the other hand, in the antenna 100 in the example illustrated in FIGS. 1 and 2, since the radiating portion 180 is spaced apart from the feed portion 130, the feed portion 130 does not directly feed the radiating portion 180, but feeds the radiating portion 180 through a coupling with the radiating portion 180. As a result, a radiating frequency of the antenna 100 is determined by a combination of the length of the feed pads 131*a* and 131*b*, a phase difference of the signal applied to the feed pads 131*a* and 131*b*, and the length of the radiating portion 180.

Thus, sizes of the feed pads 131*a* and 131*b* are not directly related to the length of a half wavelength of the frequency. Therefore, the feed pads 131*a* and 131*b* may have a length shorter than a length of the radiating portion of the conventional dipole antenna. Further, the size of the radiating portion 180 may be defined based on the sizes of the feed pads 131*a* and 131*b*.

Accordingly, the radiating portion 180 may have a length that is 70% or less of the length of the radiating portion of the conventional dipole antenna, thereby significantly reducing the radiating area of the antenna.

Further, an input impedance of the antenna 100 may be matched to an output impedance of a signal processing element applying a signal to the feed portions 133*a* and 133*b* by adjusting a position or an area of the feed portion 130. For example, the input impedance of the antenna 100 may be matched to the output impedance of the signal processing element by adjusting the length and the width of the feed pads 131*a* and 131*b*, and a phase of a signal transferred to the feed portion 130 may be adjusted by changing positions of the vias 132*a* and 132*b* connected to the feed pads 131*a* and 131*b*.

Further, the antenna 100 has a structure that may be used as a multiple feed structure. More specifically, a signal processing element that applies a signal to the feed portion 130 may be connected to both the first feed portion 130*a* and the second feed portion 130*b*, and may simultaneously apply the same signal to both the first feed portion 130*a* and the second feed portion 130*b*. Therefore, the amplitude of the input signal of the antenna 100 may be increased, thereby increasing a radiation gain of the antenna 100.

In the case of a conventional dipole antenna in which the radiating portion directly extends from the feed portion, two feed pads should be spaced apart from each other by a very small distance for the radiating portion to maintain a dipole form. However, in the antenna 100 illustrated in FIGS. 1 and 2, since the radiating portion 180 is not connected to the feed portion 130, but is spaced apart from the feed portion 130, the feed pads 131*a* and 131*b* may be disposed at various positions within the region facing the radiating portion 180. Therefore, a degree of freedom of a feeding position of the antenna 100 is higher than in the conventional dipole antenna.

The antenna 100 is not limited to the example described above, but may be modified in various ways.

Figure 5:
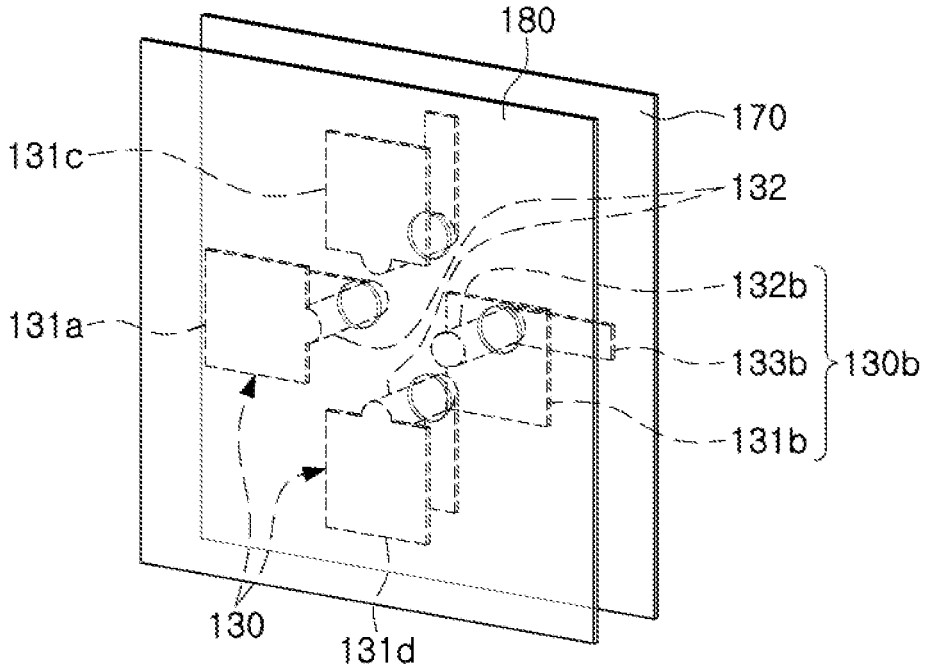
FIG. 5 is a perspective view schematically illustrating another example of an antenna.

FIG. 5 is a perspective view schematically illustrating another example of an antenna, and illustrates a structure in which an insulating member is omitted as in the example illustrated in FIG. 2.

Referring to FIG. 5, the antenna includes four feed portions 130. Each feed portion 130 includes a feed pad 131, a feed pattern 133, and a via 132 connecting the feed pattern 133 and the feed pad 131 to each other. Therefore, the antenna includes four feed pads 131*a*, 131*b*, 131*c*, and 131*d*.

However, the antenna is not limited thereto, and may be modified to include more than four feed portions 130. For example, the antenna may include six or eight feed portions 130.

The four feed pads 131*a*, 131*b*, 131*c*, and 131*d* are disposed in four directions relative to a central point between the four feed pads 131*a*, 131*b*, 131*c*, and 131*d*, and the vias 132 are disposed adjacent to one another.

Like the example illustrated in FIGS. 1 and 2 described above, the feed pads 131*a*, 131*b*, 131*c*, and 131*d* of the antenna in the example illustrated in FIG. 5 are also disposed at positions at which the entirety of the feed pads 131*a*, 131*b*, 131*c*, and 131*d* faces the radiating portion 180.

The feed pads 131*a* and 131*b* are disposed in a first line extending in a first direction (a horizontal direction in the example in FIG. 5) and are spaced apart from each other, and the feed pads 131*c* and 131*d* are disposed in a second line extending in a second direction (a vertical direction in the example illustrated in FIG. 5) different from the first direction and are spaced apart from each other.

The antenna in the example illustrated in FIG. 5 having the configuration described above may be used to transmit signals having a dual polarization. Further, since two feed portions 130 are provided for each of two polarizations (for example, a vertical polarization and a horizontal polarization), multiple feeding may be implemented. For example, a first signal having a horizontal polarization may be fed to both of the feed pads 131*a* and 131*b*, and a second signal having a vertical polarization may be fed to both of the feed pads 131*c* and 131*d*.

Figure 6:
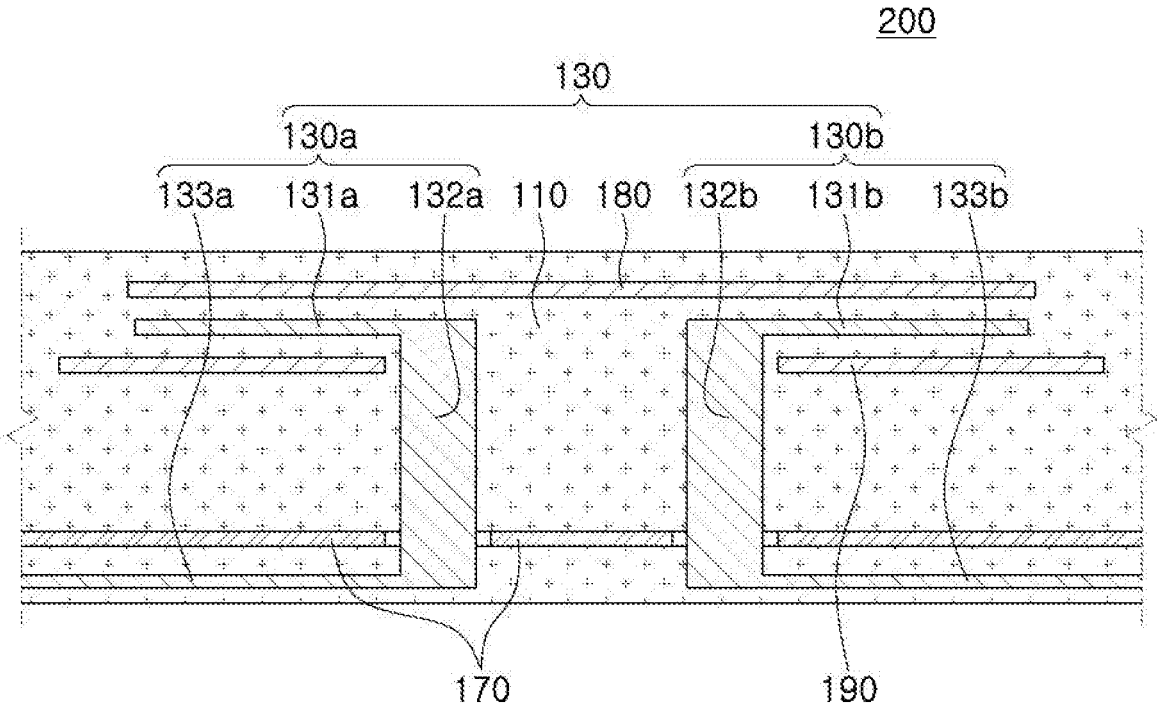
FIG. 6 is a cross-sectional view schematically illustrating another example of an antenna.
Figure 7:
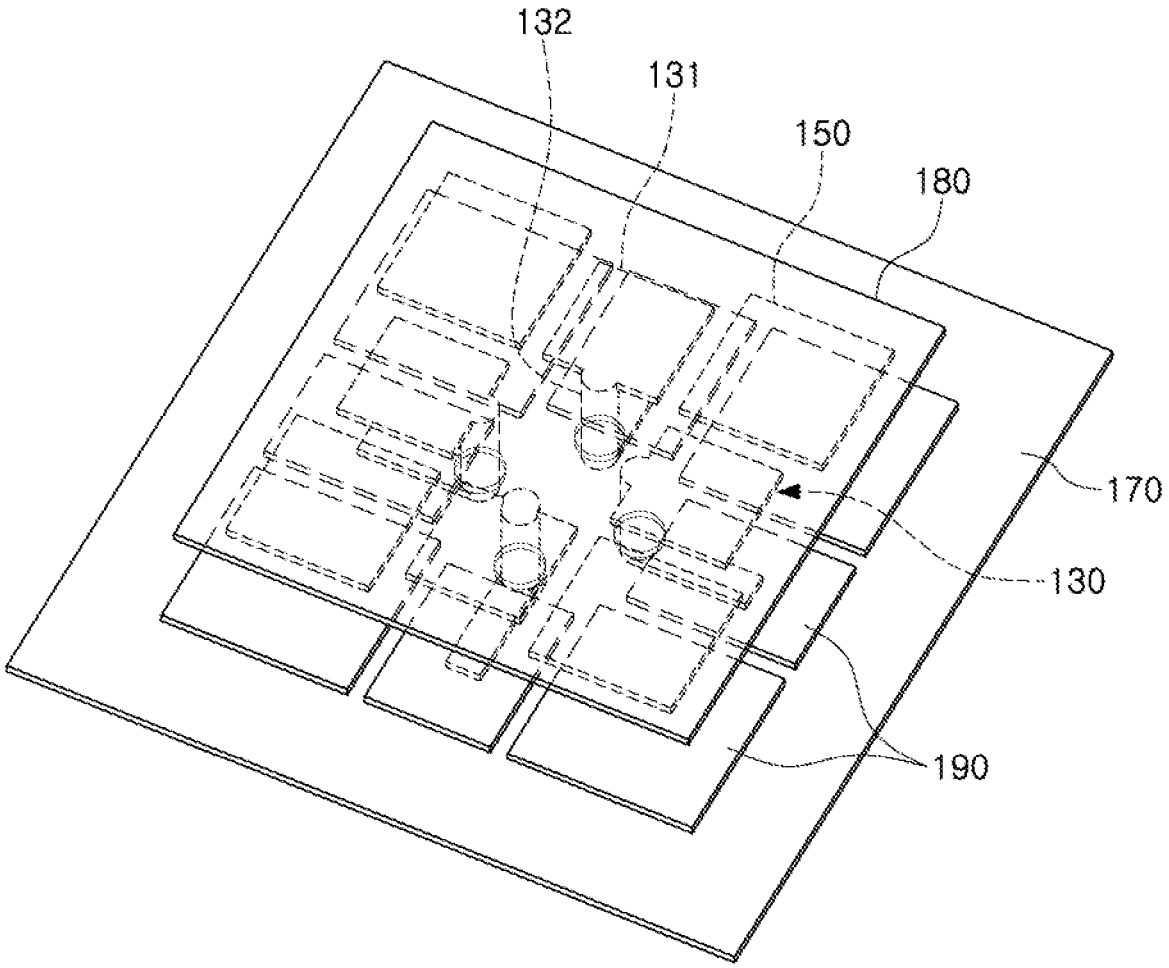
FIG. 7 is a perspective view of the antenna illustrated in FIG. 6.

FIG. 6 is a cross-sectional view schematically illustrating another example of an antenna, and FIG. 7 is a perspective view of the antenna illustrated in FIG. 6 in which an insulating member is omitted.

Referring to FIGS. 6 and 7, an antenna 200 includes a meta ground part 190 and a dummy pattern 150 disposed between the radiating portion 180 and the ground part 170.

The meta ground part 190 is disposed between the feed pads 131 and the ground part 170. The meta ground part 190 is disposed parallel to the feed pads 131 and the ground part 170, and is not electrically connected to the feed pads 130 or the ground part 170.

The meta ground part 190 is disposed closer to the feed pads 131 than the ground part 170.

If the meta ground part 190 is electrically connected to the ground part 170, the meta ground part 190 will operate as the ground part 170. In this case, since the meta ground part 190 and the feed pads 131 are disposed very close to each other, a signal loss may occur.

Therefore, the meta ground part 190 a is not electrically connected to the ground part 170 or the feed portions 130, and is implemented as a plurality of dummy conductive pads arranged in a mesh configuration or a lattice configuration.

The size of the radiating portion 180 needs to be reduced as a distance between the feed pads 131 and the ground part 170 is increased. However, In the example illustrated in FIGS. 6 and 7, since the meta ground part 190 operates as an analogous ground part, the size of the radiating portion 180 may remain large even though the distance between the feed pads 131 and the ground part 170 is large, thereby implementing a high gain antenna.

Like the meta ground part 190, the dummy pattern 150 is implemented as a plurality of dummy conductive pads.

The dummy pattern 150 is disposed on the same plane as the plane on which the feed pads 131 are disposed, and is spaced apart from the feed pads 131 by a predetermined distance. However, the dummy pattern 150 is not limited thereto, but may alternatively be disposed on another plane within the substrate that is different from the plane on which the feed pads 131 are disposed. Further, the dummy pattern 150 may include dummy conductive pads disposed on a plurality of different planes within the substrate, rather than on a single plane.

The dummy pattern 150 is disposed so that an entire region thereof faces the radiating portion 180. On the other hand, the meta ground part 190 may be disposed so that an entire region thereof faces the radiating portion 180, or may be disposed so that only a portion of the entire region thereof faces the radiating portion 180 and a remaining portion of the entire region thereof does not face the radiating portion.

In the example illustrated in FIGS. 6 and 7, the dummy pattern 150 is disposed between the four feed pads 131 disposed in four directions relative to a central point between the four feed pads 131*a*, 131*b*, 131*c*, and 131*d*. That is, the dummy pattern 150 in the example illustrated in FIGS. 6 and 7 includes four conductive pads, and each of the conductive pads is disposed between a different pair of two feed pads 131 of the four feed pads 131.

Further, in the example illustrated in FIGS. 6 and 7, the meta ground part 190 has eight conductive pads facing the conductive pads of the dummy pattern 150 and the feed pads 131. In the example illustrated in FIGS. 6 and 7, the meta ground part 190 has a form in which the eight conductive pads are disposed in a quadrangular ring shape with a central portion of the quadrangular ring shape being empty. However, the meta ground part 190 is not limited to this configuration.

Figure 8:
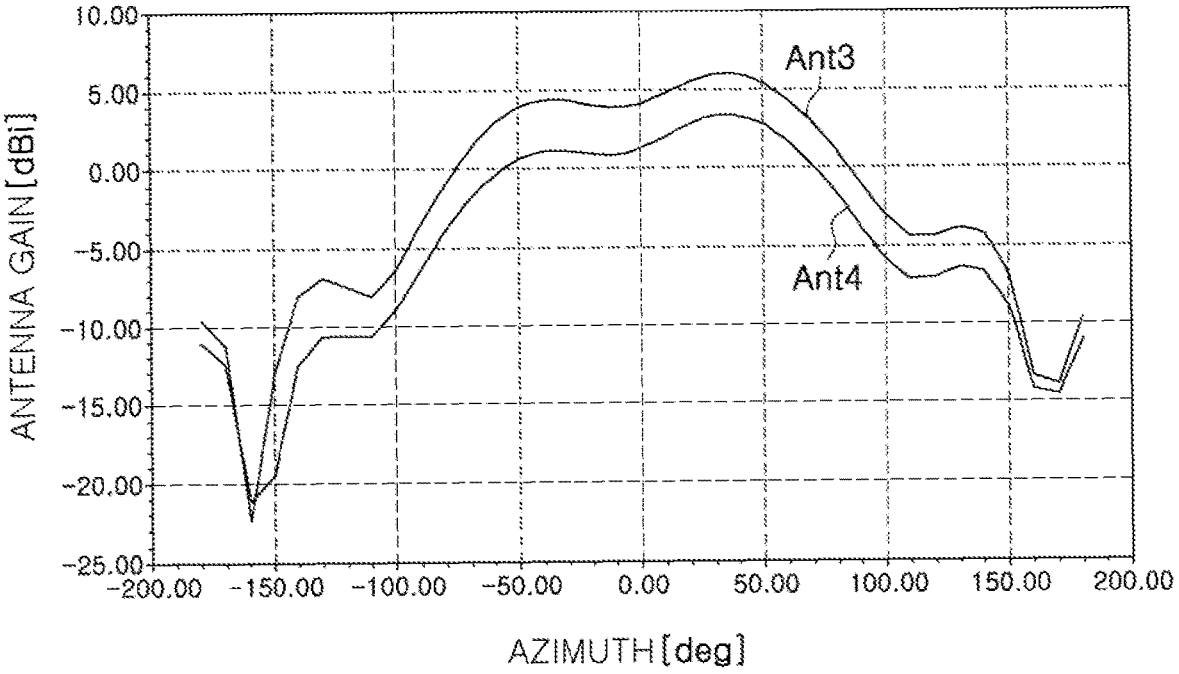
FIG. 8 is a graph illustrating an antenna gain measured for the antenna illustrated in FIG. 6.

FIG. 8 is a graph illustrating an antenna gain measured for the antenna illustrated in FIG. 6. In FIG. 8, Ant3 denotes a third antenna that is the antenna illustrated in FIG. 6, and Ant3 denotes a fourth antenna that is the same as the antenna illustrated in FIG. 6 except that the fourth antenna Ant4 does not include the meta ground part 190 and the dummy pattern 150.

Referring to FIG. 8, it can be seen that the antenna gain for the third antenna Ant3 that is the antenna illustrated in FIG. 6 was generally measured to be 2 to 3 dB higher than the gain for he fourth antenna Ant 4. Therefore, it may be seen that antenna efficiency is improved.

Although the antenna illustrated in FIGS. 6 and 7 includes both the meta ground part 190 and the dummy pattern 150, in another example, the antenna may also include only the meta ground part 190 or only the dummy pattern 150.

Figure 9:
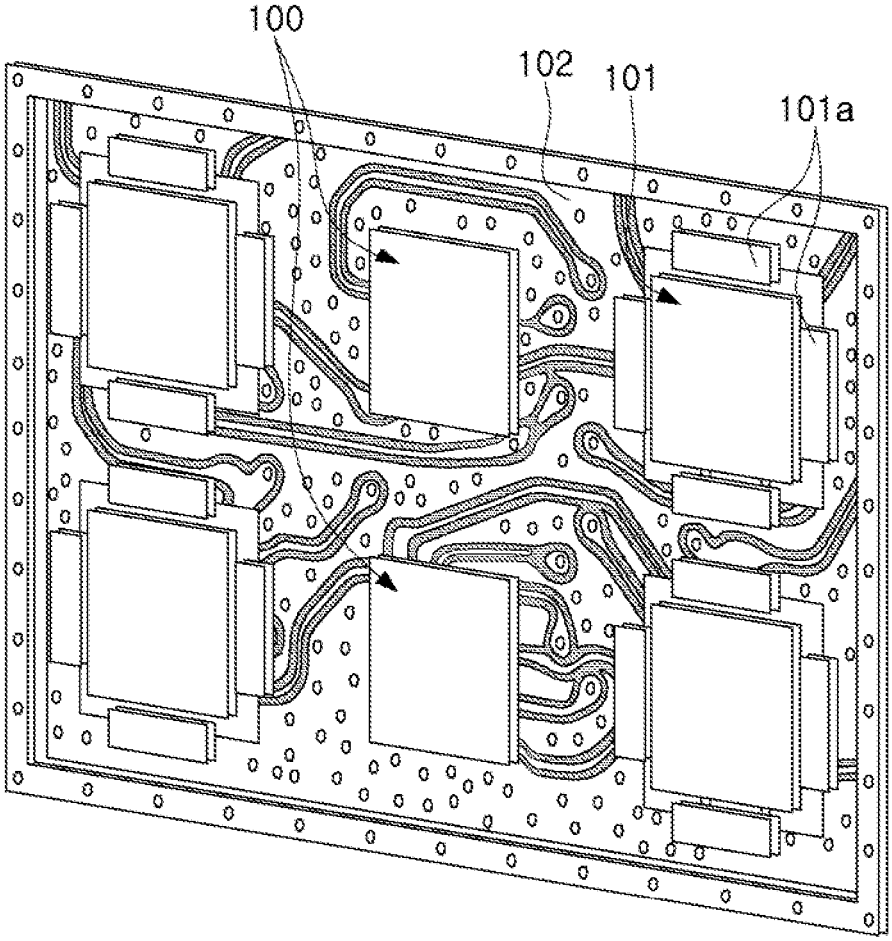
FIG. 9 is a perspective view schematically illustrating an example of an antenna module. Throughout the drawings and the detailed description, the same reference numerals refer to the same elements. The drawings may not be to scale, and the relative size, proportions, and depiction of elements in the drawings may be exaggerated for clarity, illustration, and convenience.

FIG. 9 is a perspective view schematically illustrating an example of an antenna module.

Referring to FIG. 9, the antenna module is an antenna module for Wi-Fi operating at a frequency of 60 GHz, and includes a plurality of antennas 100 and 101 mounted on one surface of a circuit board 102, and one or more signal processing elements (not shown) connected to the antennas 100 and 101. The signal processing elements may be mounted on an opposite surface of the circuit board 102 from the antennas 100 and 101, but are not limited thereto.

The plurality of antennas 100 and 101 may operate as an array antenna.

In one example, at least one of the plurality of antennas 100 and 101 is the antenna 100 illustrated in FIG. 2. However, in another example, at least one of the plurality of antennas 100 and 101 is the antenna illustrated in FIG. 5 or the antenna 200 illustrated in FIG. 7. In another example, all of the plurality of antennas 100 and 101, rather at least one thereof, are the antenna 100 illustrated in FIG. 2 or the antenna illustrated in FIG. 5 or the antenna 200 illustrated in FIG. 7.

In the antenna module illustrated in FIG. 9, the antennas 101 other than the antenna 100 according to this application are conventional antennas that do not have the multiple feed structure of the antenna 100 according to this application, but have a single feed portion for each polarization. As such, the antenna 100 according to this application may also be coupled to the conventional antenna as needed to operate as an array antenna.

In the example in FIG. 9, he conventional antenna 101 includes dummy metal plates 101*a* disposed around a radiating portion. These dummy metal plates 101*a* are provided to increase a radiation efficiency of the conventional antenna 101. Therefore, although not shown in the drawings, the dummy metal plates 101*a* may also be applied to the antenna 100 according to this application as needed.

As described above, the examples of the antenna and the antenna module described above significantly reduce the area of the radiating portion of the antenna. As a result, a small-size antenna capable of being used in the EHF band may be implemented.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna comprising:

feed pads;

a radiating portion disposed on one side of the feed pads and spaced apart from the feed pads, the radiating portion being constituted by a single conductor plate;

a ground part disposed on an opposite side of the feed pads from the radiating portion; and a meta ground part disposed between the feed pads and the ground part, wherein the meta ground part is not electrically connected to any of the feed pads and the ground part, and wherein the meta ground part is disposed closer to the feed pads than the ground part.

2. The antenna of claim 1, wherein the feed pads are disposed so that all portions of the feed pads face the radiating portion.

3. The antenna of claim 2, wherein the feed pads comprise a first feed pad and a second feed pad disposed in a line and spaced apart from each other.

4. The antenna of claim 3, further comprising:

a first via having a first end coupled to the first feed pad; and a second via having a first end coupled to the second feed pad.

5. The antenna of claim 4, further comprising a first feed pattern and a second feed pattern disposed on an opposite side of the ground part from the first feed pad and the second feed pad and spaced apart from the ground part;

wherein the first via and the second via penetrate through the ground part;

a second end of the first via is connected to the first feed pattern; and a second end of the second via is connected to the second feed pattern.

6. The antenna of claim 2, wherein each of the feed pads has a rectangular shape.

7. The antenna of claim 6, wherein the radiating portion has a rectangular shape;

a length of each of the feed pads is 40% or less of a length of the radiating portion; and a width of each of the feed pads is 30% or less of a width of the radiating portion.

8. The antenna of claim 2, wherein a radiating frequency of the antenna is determined by a combination of a length of one of the feed pads and a length of the radiating portion; and an impedance of the antenna is determined by either one or both of a position of the one feed pad and an area of the one feed pad.

9. The antenna of claim 2, wherein the feed pads comprise four feed pads disposed in four directions relative to a central point between the four feed pads to enable the antenna to receive a signal having a dual polarization.

10. The antenna of claim 1, wherein the meta ground part comprises eight conductive pads disposed in a quadrangular ring shape.

11. The antenna of claim 1, further comprising a dummy pattern;

wherein the feed pads and the dummy pattern are disposed on a same plane.

12. The antenna of claim 11, wherein the feed pads comprise four feed pads disposed in four directions relative to a central point between the four feed pads; and the dummy pattern comprises four conductive pads disposed so that each of the four conductive pads is disposed between a different pair of two feed pads of the four feed pads.

13. An antenna module comprising:

the antenna of claim 1; and a signal processing element electrically connected to the feed pads and configured to transmit and receive a signal via the antenna.

14. The antenna module of claim 13, further comprising an additional antenna;

wherein the antenna of claim 1 and the additional antenna are configured to operate as an array antenna.

15. The antenna module of claim 13, wherein the antenna of claim 1 is an antenna for Wi-Fi operating at a frequency of 60 GHz.

16. The antenna of claim 1, wherein each of the feed pads has a polygonal shape.

17. An antenna comprising:

feed pads;

a radiating portion disposed on one side of the feed pads and spaced apart from the feed pads, the radiating portion being constituted by a single conductor plate;

a ground part disposed on an opposite side of the feed pads from the radiating portion; and a dummy pattern disposed between the ground part and the radiating portion, wherein the dummy pattern and the radiating portion overlap each other when viewed in a direction normal to the radiating portion, wherein the dummy pattern and the feed pads do not overlap each other when viewed in the direction normal to the radiating portion, and wherein a portion of the dummy pattern is disposed outside of a periphery of the radiating portion.

18. The antenna of claim 17, wherein the dummy pattern is disposed so that a portion of the dummy pattern faces the radiating portion.

19. The antenna of claim 17, wherein the feed pads and the dummy pattern are disposed on a same plane.

20. The antenna of claim 19, further comprising a meta ground part disposed between the feed pads and the ground part, wherein the meta ground part is electrically insulated from the feed pads and the ground part.

* * * * *